US010653292B2

(12) United States Patent
Steck et al.

(10) Patent No.: US 10,653,292 B2
(45) Date of Patent: May 19, 2020

(54) LIFTING DEVICE AND DISHWASHER

(71) Applicants: BSH Hausgeräte GmbH, Munich (DE); Paul Hettich GmbH & Co. KG, Kirchlengern (DE)

(72) Inventors: Thomas Steck, Holzheim (DE); Norbert Gerstner, Herbrechtingen (DE); Ersin Isbilen, Lauingen (DE); Martin Heinle, Glött (DE)

(73) Assignee: BSH Hausgeräte GmbH, Munich (DE)

( * ) Notice: Subject to any disclaimer, the term of this patent is extended or adjusted under 35 U.S.C. 154(b) by 149 days.

(21) Appl. No.: 15/751,484

(22) PCT Filed: Aug. 17, 2016

(86) PCT No.: PCT/EP2016/069463
§ 371 (c)(1),
(2) Date: Feb. 9, 2018

(87) PCT Pub. No.: WO2017/032653
PCT Pub. Date: Mar. 2, 2017

(65) Prior Publication Data

US 2018/0220869 A1 Aug. 9, 2018

(30) Foreign Application Priority Data

Aug. 21, 2015 (DE) ..... 10 2015 216 057

(51) Int. Cl.
*A47L 15/50* (2006.01)

(52) U.S. Cl.
CPC ..... *A47L 15/506* (2013.01)

(58) Field of Classification Search
CPC ..... A47L 15/506
See application file for complete search history.

(56) References Cited

U.S. PATENT DOCUMENTS 5,971,513 A * 10/1999 Cassalia ..... A47L 15/506 312/272
2004/0163687 A1 8/2004 Son et al.
(Continued)

FOREIGN PATENT DOCUMENTS

DE 102012209300 A1 12/2013
EP 1066789 A1 1/2001
(Continued)

OTHER PUBLICATIONS

DE102012209300A1 Machine Translation (Year: 2013).*
International Search Report PCT/EP2016/069463 dated Oct. 20, 2016.

*Primary Examiner* — Spencer E Bell
(74) *Attorney, Agent, or Firm* — Michael E. Tschupp; Andre Pallapies; Brandon G. Braun

(57) ABSTRACT

A lifting device for a receptacle for items to be washed of a dishwasher, in particular a household dishwasher is constructed to lift the receptacle from a starting position, optionally via at least one intermediate position, into an end position or to lower the washing item receptacle from the end position, optionally via at least one intermediate position, into the starting position. The lifting device includes a braking device having at least one damping element which is designed to brake a movement of the 32-receptacle in particular during the lowering process.

19 Claims, 9 Drawing Sheets

(56) References Cited

U.S. PATENT DOCUMENTS

| | | | |
|---|---|---|---|
| 2004/0244825 | A1 | 12/2004 | Ashton |
| 2008/0129168 | A1 | 6/2008 | Banta et al. |
| 2015/0305493 | A1 | 10/2015 | Garcia et al. |

FOREIGN PATENT DOCUMENTS

| | | | |
|---|---|---|---|
| JP | 2006204591 | A | 8/2006 |
| WO | 2008038320 | A1 | 4/2008 |
| WO | 2009135609 | A1 | 11/2009 |

* cited by examiner

LIFTING DEVICE AND DISHWASHER

CROSS-REFERENCES TO RELATED APPLICATIONS

This application is the U.S. National Stage of International Application No. PCT/EP2016/069463, filed Aug. 17, 2016, which designated the United States and has been published as International Publication No. WO 2017/032653 A1 and which claims the priority of German Patent Application, Serial No. 10 2015 216 057.2, filed Aug. 21, 2015, pursuant to 35 U.S.C. 119(a)-(d).

BACKGROUND OF THE INVENTION

The present invention relates to a lifting device for a receptacle for items to be washed of a dishwasher, in particular of a household dishwasher and a dishwasher, in particular a household dishwasher.

A dishwasher, in particular a household dishwasher, has a dishwasher cavity and at least one receptacle for items to be washed that can be moved into or out of the dishwasher cavity. The dishwasher can have a number of receptacles for items to be washed that are arranged one above the other, such as for instance a bottom basket, a top basket or a cutlery basket. Since the bottom basket is arranged close to a base of the dishwasher cavity, in order to load and unload the bottom basket it is necessary for the user to flex his knees or bend towards the bottom basket.

The publication DE 10 2012 107 993 A1 discloses a lifting device for lifting a bottom basket of a dishwasher. The lifting device comprises a drive facility in the form of a spring to support the lifting of the bottom basket. The lifting device has two pivot arms, which are pivotably supported on a dishwasher cavity and a guide facility of the bottom basket. The bottom basket is lifted by pivoting the pivot arms.

The publication EP 1 066 789 A1 likewise discloses a lifting device for lifting a bottom basket of a dishwasher. The lifting device comprises an electrically powered scissors lift.

The publication DE 2008/0129168 A1 likewise discloses a lifting device for lifting a bottom basket of a dishwasher. The lifting device comprises two pivot arms, which can be pivoted in order to lift the bottom basket. Furthermore, the lifting device has a drive facility in the form of a spring or a pneumatic spring.

BRIEF SUMMARY OF THE INVENTION

Against this background an object of the present invention consists in making available an improved lifting device.

Accordingly a lifting device for a receptacle for items to be washed of a dishwasher, in particular of a household dishwasher, is proposed. The lifting device is designed to lift the receptacle for items to be washed from a starting position, optionally via at least one intermediate position, into an end position or to lower same from the end position, optionally via at least one intermediate position, into the starting position, wherein the lifting device has a braking facility with at least one damping element, which is designed to brake a movement of the receptacle for items to be washed in particular during the lowering process.

The lifting device is in particular designed to lift the receptacle for items to be washed from the starting position via at least one intermediate position into the end position or from the end position via the at least one intermediate position into the starting position, wherein the lifting device has the braking facility with the at least one damping element, which is designed to at least partially brake the movement of the receptacle for items to be washed in particular during the lowering process and preferably in a lower region of the movement of the receptacle for items to be washed. The damping element may be a damping facility or referred to as a damping facility. As a result of the lifting device having the braking facility, an uncontrolled movement of the receptacle for items to be washed is prevented in particular during the lowering process from the end position into the starting position. Injury to a user or damage to the item to be washed is avoided as a result. The damping element can also be designed to brake a movement of the receptacle for items to be washed only during the lowering process. With the aid of the lifting device, the receptacle for items to be washed, which is preferably a lower receptacle for items to be washed or a bottom basket of the dishwasher, can be lifted to the same height as an upper receptacle for items to be washed or a top basket of the dishwasher. This allows the bottom basket to be loaded and unloaded easily. The damping element may be a gas damper, an oil damper, a centrifugal force damper and/or a rotation damper. The braking facility may have any number of damping elements. The braking facility may further comprise various types of damping elements. For instance, a centrifugal force damper or a rotation damper can be provided at a bearing point or a pivot point of the lifting device. In such cases the centrifugal force damper or the rotation damper can be coupled to the pivot point or the bearing point with the aid of a transmission or a gearing.

According to one embodiment, a damping effect of the at least one damping element can be set.

In this way the damping effect can be adjusted depending on the load or direction of movement of the receptacle for items to be washed, for instance.

According to a further embodiment, the damping effect of the at least one damping element can be set such that the movement of the receptacle for items to be washed can be braked more significantly in particular during the lowering process of the same than when lifting the same.

In this way when the receptacle for items to be washed it lifted, it is not necessary to move the receptacle for items to be washed upwards against the damping effect of the damping element. This improves ease of use.

According to a further embodiment, the at least one damping element can be switched off.

In this way the braking effect of the braking facility can be completely switched off. To this end the damping element can have a controllable throttle, for instance. With the aid of the throttle the lowering speed of the receptacle for items to be washed can be set, for instance. Furthermore, the damping element can also be set with the aid of the throttle such that when the receptacle for items to be washed is lifted from the starting position into the end position, its movement is not braked or is braked at least less than during the lowering process.

Alternatively, the damping element can have a conical expansion element, which is arranged in a housing. The expansion body can expand radially in particular. The damping element can preferably be brought from an unactuated or deactivated state into an actuated or activated state. In the unactuated state the expansion body is arranged in a conical body. If the expansion body prestressed with the aid of a spring element is released, this expands and makes contact with an inner wall of the housing. A damping effect is achieved by contact between the expansion element and the housing.

Furthermore, the damping element can comprise a housing, in which a linearly moveable conical body is arranged, which, with the aid of a spring element, in particular a compression spring, is prestressed in the direction of a friction body. The friction body can be divided completely into various segments. When a damper stay of the damping element is moved, the conical body is moved into the friction body, as a result of which this is pressed against an inner wall of the housing. The required damping effect can be set by way of the contact surface, the spring force of the spring element and the friction coefficients of the various materials of the friction body and the housing. The damping effect is preferably activated or deactivated by displacing the damper stay so that when the damper stay is pulled out of the housing, in other words when the receptacle for items to be washed is lowered, the damping element is activated and when the damper stay is slid into the same, in other words when the receptacle for items to be washed is lifted into the housing, the damping element is deactivated.

According to a further embodiment, the at least one damping element can be switched off such that the movement of the receptacle for items to be washed can be braked only during the lowering process of the same and unbraked during the lifting process of the same.

In this way ease of use is improved since the receptacle for items to be washed does not have to be lifted against the braking effect of the braking facility.

According to a further embodiment, the at least one damping element is coupled to an actuation lever of the lifting device for controlling the same.

The actuation lever can also be coupled to a stop facility, which is designed to stop the receptacle for items to be washed in the starting position and/or in at least one intermediate position and/or the end position. The stopping mechanism can be triggered by actuating the actuation lever. The damping element can be coupled to the actuation lever for instance such that the damping element is deactivated during the lifting process of the receptacle for items to be washed and in particular during the lowering process of the same.

According to a further embodiment, the lifting device comprises a scissors lift for lifting and lowering the receptacle for items to be washed.

This ensures a controlled and uniform lifting and lowering of the receptacle for items to be washed.

According to a further embodiment, the scissors lift comprises a first scissor arm and a second scissor arm, which intersect one another and are pivotably connected to one another at a pivot point, wherein the scissor arms can be pivoted relative to one another in order to lift and lower the receptacle for items to be washed so that the receptacle for items to be washed can be lifted and lowered as a function of a pivot angle provided between the scissor arms.

In a pulled-out state of the scissors lift the pivot angle is preferably larger than in a retracted state. Wheels which are designed to roll on an opened door of the dishwasher washer can be provided at the ends of the scissor arms. The actuation lever is coupled to one of the scissor arms with the aid of an intermediate lever in particular.

According to a further embodiment, the at least one damping element is arranged between the scissor arms, between the scissor arms and a receptacle carrier for items to be washed of the lifting device and/or on the pivot point of the scissor arms.

The damping element can connect the first scissor arm to the second scissor arm, for instance. Furthermore, the damping element can be provided between the first scissor arm and the receptacle carrier for items to be washed or between the second scissor arm and the receptacle carrier for items to be washed. A gearing or a transmission can be provided on the pivot point, with the aid of which the damping element is coupled to the pivot point. In particular, a bearing point of the first scissor arm is rotatably connected to the receptacle carrier for items to be washed, wherein a bearing point of the second scissor arm can be moved linearly relative to the receptacle carrier for items to be washed. Furthermore, the damping element can be provided on the bearing point of the second scissor arm on the receptacle carrier for items to be washed. The damping element provided on the bearing point of the second scissor arm can be a rotation damper or a linear damper.

According to a further embodiment, the lifting device can be moved in and out of a dishwasher cavity of the dishwasher when the scissors lift is retracted.

To this end, the scissors lift can have wheels, which roll on an inner surface of the door. An end segment of one of the scissor arms is pivotably connected to the receptacle for items to be washed, wherein a wheel is provided at one end segment of the other scissor arm, which is designed to roll on a bearing surface of the receptacle carrier for items to be washed.

According to a further embodiment, the lifting device comprises a first pivot arm and a second pivot arm, which are each pivotably fastened to a dishwasher cavity of the dishwasher and to a guide facility of the lifting device.

When moving the receptacle for items to be washed from the starting position into the end position, optionally via at least one intermediate position, the scissor arms move parallel to one another. With the aid of the pivotable pivot arms, the lower receptacle for items to be washed can be lifted to the height of the upper receptacle for items to be washed.

According to a further embodiment, the at least one damping element is provided between the pivot arms, between one of the pivot arms and the guide facility, between one of the pivot arms and a fastening plate of the lifting device and/or at pivot points of the pivot arms on the guide facility or on the fastening plate.

The fastening plate is preferably fastened to a side wall of the dishwasher cavity of the dishwasher. In particular, two pivot arms are provided on both sides of the receptacle for items to be washed in each case.

According to a further embodiment, the lifting device comprises a drive facility, which is designed to support the manual lifting or lowering using a supporting force during the manual lifting or lowering process of the receptacle for items to be washed.

In this way it is not necessary for a user to lift the receptacle for items to be washed against the entire weight force of the washing item received in the receptacle for items to be washed. This improves ease of use. The drive facility is preferably designed only to support the lifting of the receptacle for items to be washed using the supporting force.

According to a further embodiment, the drive facility comprises a spring element.

In particular, the drive facility comprises at least one spring element. The spring element is in particular a tension spring. Optionally the lifting device can also comprise an electric motor such as for instance a servomotor.

Furthermore, a dishwasher is proposed, in particular a household dishwasher, with a dishwasher cavity, a receptacle for items to be washed which can be received in the dishwasher cavity and a lifting device of this type.

The dishwasher cavity preferably has a base, a ceiling facing the base, two side walls, a closeable door and a rear wall arranged opposite to the door. The dishwasher cavity is preferably rectangular. The dishwasher cavity can be produced from a steel material, in particular from steel sheet. Optionally the base can be manufactured from a plastic material.

Further possible implementations of the lifting device and/or of the dishwasher also comprise combinations—not explicitly cited—of features or embodiments described above or below in respect of the exemplary embodiments. In such cases the person skilled in the art will also add individual aspects as improvements or amendments to the respective basic form of the lifting device and/or of the dishwasher.

BRIEF DESCRIPTION OF THE DRAWINGS

Further advantageous embodiments and aspects of the lifting device and/or of the dishwasher form the subject matter of the subclaims and the exemplary embodiments of the lifting device and/or of the dishwasher described below. The lifting device and/or the dishwasher are further explained in greater detail below on the basis of the preferred embodiments with reference to the appended figures, in which

DETAILED DESCRIPTION OF EXEMPLARY EMBODIMENTS OF THE PRESENT INVENTION

Figure 1:
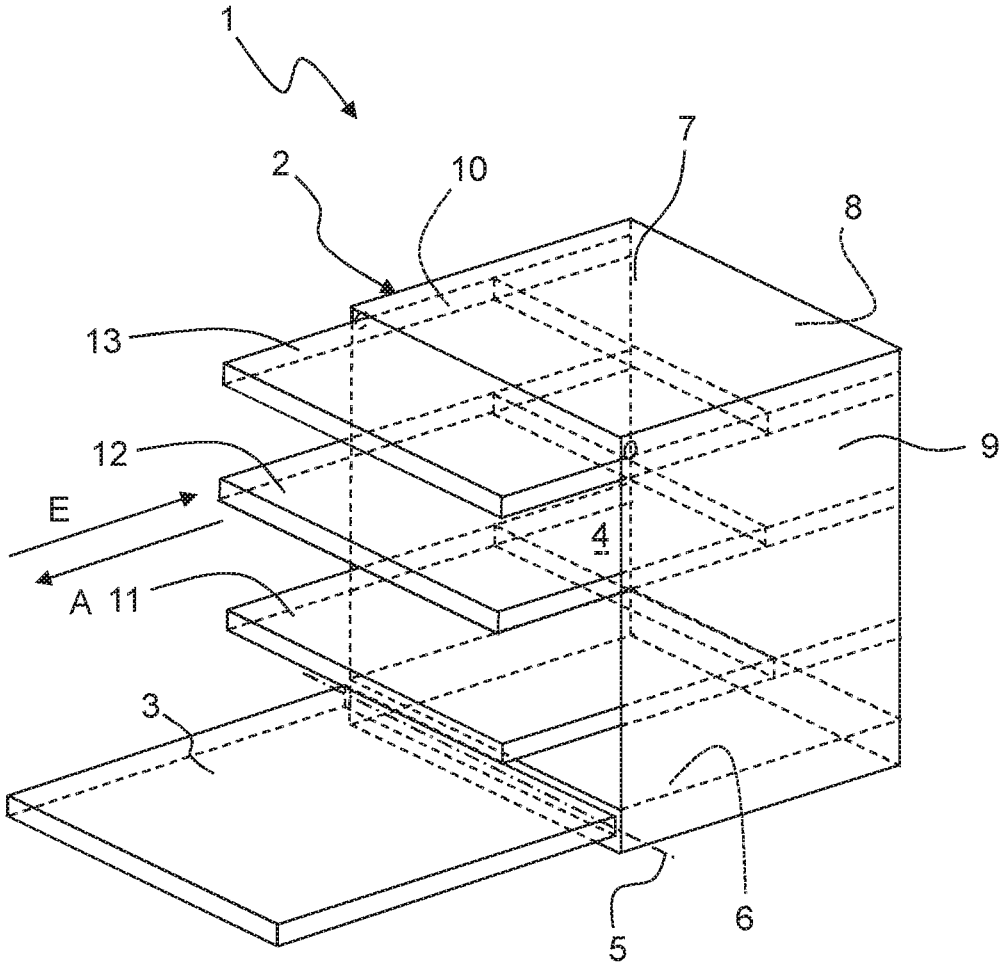
FIG. 1 shows a schematic perspective view of an embodiment of a dishwasher.

Elements which are the same or function the same have been provided with the same reference characters in the figures, unless specified otherwise.

FIG. 1 shows a schematic perspective view of an embodiment of a dishwasher 1. The dishwasher 1 is a household dishwasher. The dishwasher 1 has a dishwasher cavity 2 which can be closed, in particular in a water-tight manner, by a door 3. To this end a sealing facility can be provided between the door 3 and the dishwasher cavity 2. The dishwasher cavity 2 is preferably rectangular. The dishwasher cavity 2 can be arranged in a housing of the dishwasher 1. The dishwasher cavity 2 and the door 3 can form a washing chamber 4 for washing items to be washed.

The door 3 is shown in its open position in FIG. 1. The door 3 can be closed or opened by pivoting about a pivot axis 5 provided at a lower end of the door 3. The dishwasher cavity 2 has a base 6, a ceiling 7 arranged opposite to the base 6, a rear wall 8 arranged opposite to the door 3 and two side walls 9, 10 arranged facing one another. The base 6, the ceiling 7, the rear wall 8 and the side walls 9, 10 can be manufactured from stainless steel sheet, for instance. Alternatively, the base 6 can be manufactured from a plastic material for instance.

The dishwasher 1 also has at least one receptacle for items to be washed 11 to 13. Several, for instance three, receptacles for items to be washed 11 to 13 can preferably be provided, wherein the receptacle for items to be washed 11 may be a lower receptacle for items to be washed or a bottom basket, the receptacle for items to be washed 12 may be a top receptacle for items to be washed or a top basket and the receptacle for items to be washed 13 may be a cutlery basket. As also shown in FIG. 1, the receptacles for items to be washed 11 to 13 are arranged one on top of the other in the dishwasher cavity 2. Each receptacle for items to be washed 11 to 13 can optionally be moved in or out of the dishwasher cavity. In particular, each receptacle for items to be washed 11 to 13 can be moved into the dishwasher cavity 2 in an insertion direction E and can be removed from the dishwasher cavity 2 counter to the insertion direction E in an extraction direction A. The receptacle for items to be washed 11 can also be lifted using a lifting device, to be explained in more detail below, from a starting position, optionally via at least one intermediate position, into an end position, in which it is arranged in front of the receptacle for items to be washed 12 and at the same height as this.

Figure 2:
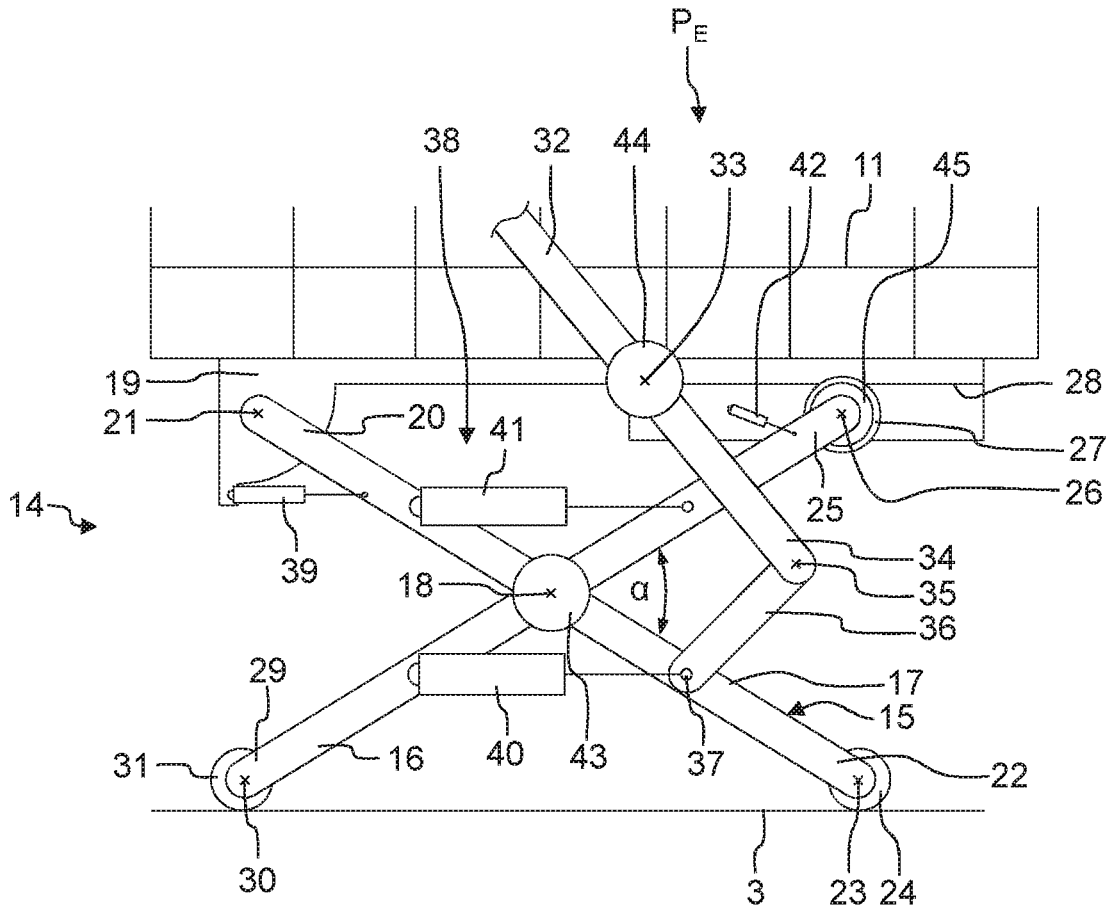
FIG. 2 shows a schematic side view of an embodiment of a lifting device for the dishwasher according to FIG. 1.
Figure 3:
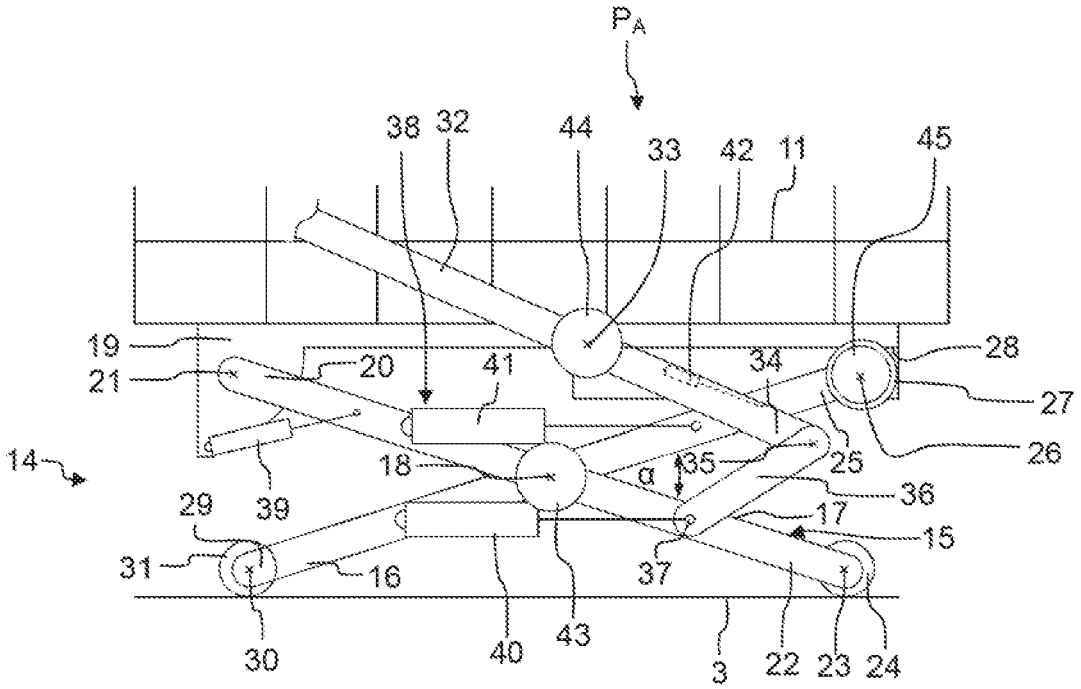
FIG. 3 shows a further schematic side view of the lifting device according to FIG. 2.

FIG. 2 shows a schematic side view of an embodiment of a lifting device 14 for the receptacle for items to be washed 11. FIG. 2 shows the receptacle for items to be washed 11 in an end position $P_E$, in which it is lifted to the height of the receptacle for items to be washed 12. FIG. 3 shows the receptacle for items to be washed 11 in the starting position $P_A$. The lifting device 14 can comprise a scissors lift 15, which, when the door 3 is opened, can be moved out of the dishwasher cavity 2 together with the receptacle for items to be washed 11 in the extraction direction A and can be moved into the dishwasher cavity 2 in the insertion direction E. The scissors lift 15 is moved apart in the end position $P_E$. The scissors lift 15 is retracted in the starting position $P_A$. The receptacle for items to be washed 11 with the lifting device 14 can only be moved into or out of the dishwasher cavity 2 when the scissors lift 15 is in the retracted state, in other words in the starting position $P_A$.

The scissors lift 15 comprises a first scissor arm 16 and a second scissor arm 17, which can be pivoted relative to one another in order to lift and lower the receptacle for items to be washed 11. The scissor arms 16, 17 are pivotably connected to one another at a pivot point 18. The pivot point 18 is provided approximately centrally on the scissor arms 16, 17. The pivot point 18 and all pivotal points mentioned again below can comprise a bearing point, such as for instance a roller bearing or a sliding bearing. The receptacle for items to be washed 11 can be lifted and lowered as a function of a pivot angle $\alpha$ between the scissor arms 16, 17. The pivot angle $\alpha$ may be greater than 90° in the end position $P_E$ and amount to 0° in the starting position $P_A$ for instance, so that the scissor arms 16, 17 are arranged parallel to one another in the starting position $P_A$. The scissors lift 15 preferably has two pairs of scissor arms 16, 17, which are arranged on both sides of the receptacle for items to be washed 11.

The lifting device 14 also comprises a receptacle carrier for items to be washed 19, which supports the receptacle for items to be washed 11. The receptacle for items to be washed 11 can be suspended, screwed, clipped or riveted in the receptacle carrier for items to be washed 19 for instance. The receptacle for items to be washed 11 can be designed to be removable from the receptacle carrier for items to be washed 19. The second scissor arm 17 is pivotably supported at a first end segment 20 with a pivot point 21 on the receptacle carrier for items to be washed 19. A second end segment 22 of the second scissor arm 17 comprises a pivot point 23, on which a wheel 24 is pivotably supported. The wheel 24 is designed to roll on the opened door 3. The wheel 24 rolls on the door 3, if the receptacle for items to be washed 11 is moved into or out of the dishwasher cavity 2 with the lifting device 14 in the starting position $P_A$. The wheel 24 also rolls on the door 3 when the receptacle for items to be washed 11 is brought from the starting position $P_A$ into the end position $P_E$ and vice versa.

A wheel 27 which can roll on a bearing surface 28 of the receptacle carrier for items to be washed 19 is pivotably supported on a first end segment 25 of the first scissor arm 16 at a pivot point 26. In other words, when the scissors lift 15 is extended or retracted, the first end segment 20 of the second scissor arm 17 is fixed to the receptacle carrier for items to be washed 19 and can only be rotated relative hereto and the first end segment 25 of the first scissor arm 16 can be moved linearly relative to the receptacle carrier for items to be washed 19, wherein the wheel 27 rolls on the bearing surface 28. A wheel 31 is pivotably supported on a second end segment 29 of the first scissor arm 16 at a pivot point 30. The wheel 31 is designed to roll on the opened door 3 like the wheel 24. The wheel 31 rolls on the door 3, if the receptacle for items to be washed 11 is moved in or out of the dishwasher cavity 2 with the lifting device 14 in the starting position $P_A$. The wheel 31 also rolls on the door 3 when the receptacle for items to be washed 11 is brought from the starting position $P_A$ into the end position $P_E$ and vice versa.

The lifting device 14 also comprises an actuation lever 32. The actuation lever 32 is pivotably supported at a pivot point 33 on the receptacle carrier for items to be washed 19. An end segment 34 of the actuation lever 32 is pivotably connected to an intermediate lever 36 at a pivot point 35. The intermediate lever 36 in turn is pivotably connected to the second scissor arm 17 at a pivot point 37. By actuating the actuation lever 32, the scissors lift 15 can be extended or retracted and the receptacle for items to be washed 11 can thus be brought from the starting position $P_A$ into the end position $P_E$ or vice versa. The lifting device 14 can also comprise a stop facility, which stops the receptacle for items to be washed 11, or the scissors lift 15, in the starting position $P_A$ and the end position $P_E$. The stopping mechanism can be triggered by actuating the actuation lever 32.

The lifting device 14 can also have a drive facility (not shown in FIG. 1 and FIG. 2). The drive facility can have a spring element or be embodied as a spring element. The drive facility is designed to support the lifting of the receptacle for items to be washed 11 from the starting position $P_A$ into the end position $P_E$ with a supporting force. The drive facility may also comprise an electric motor, in particular a servomotor, and/or a pneumatic or hydraulic drive element. The lifting device 14 can also have a control facility for controlling the drive facility. The control facility can be designed to control the drive facility as a function of a manual actuation force such that the supporting force is in particular directly proportional to the manual actuation force.

The lifting device 14 further comprises a braking facility 38 with at least one braking or damping element 39 to 45. The number of damping elements 39 to 45 is arbitrary. In particular, the damping elements 39 to 42 are linear damping elements. For instance, the damping elements 39 to 42 are embodied as gas pressure or oil pressure dampers. The damping elements 43 to 45 are embodied as rotation dampers, for instance. A rotation damper of this type can be provided essentially at each pivot point 18, 21, 23, 26, 30, 33, 35, 37 of the lifting device 14. Furthermore, the damping elements 39 to 42 can be provided for instance between the second scissor arm 17 and the receptacle carrier for items to be washed 19, between both scissor arms 16, 17 or between the first scissor arm 16 and the receptacle carrier for items to be washed 19. The braking facility 38 at least has a damping element 39 to 45 of this type. In other words, the lifting device 14 can also comprise just one damping element 39 to 45.

The damping elements 39 to 45 are designed to brake a movement of the receptacle for items to be washed 11, in particular during the lowering process from the end position $P_E$ into the starting position $P_A$. This prevents the receptacle for items to be washed 11 which is loaded with items to be washed from moving in an uncontrolled manner due to its weight from the end position $P_E$ into the starting position $P_A$. Damage to the items to be washed or injury to the user is thus ruled out. The damping elements 39 to 45 can also be designed to brake a movement of the receptacle for items to be washed 11 during the lifting process of the same, from the starting position $P_A$ into the end position $P_E$. The damping elements 39 to 45 can preferably be regulated and/or switched, so that they have a damping or braking effect only during the lowering process of the receptacle for items to be washed 11 and not during the lifting process of the same. Optionally the damping element 39 to 45 can be switched off or its braking effect can be reduced during the lifting process of the receptacle for items to be washed 11.

The mode of operation of the lifting device 14 is summarized again below. When the door 3 is opened, the receptacle for items to be washed 11, which is arranged in the starting position $P_A$, is pulled out of the dishwasher cavity 2. In such cases the wheels 24, 31 roll internally on the opened door 3. The actuation lever 32 is actuated in order to load or unload the receptacle for items to be washed 11. The receptacle for items to be washed 11 is brought from the starting position $P_A$ into the end position $P_E$. In this regard, the drive facility assists with the lifting using a supporting force. Easy loading or unloading of the receptacle for items to be washed 11 is possible as a result of the receptacle for items to be washed 11 being arranged in the end position $P_E$ at the same height as the receptacle for items to be washed 12. After loading or unloading the receptacle for items to be washed 11, this is brought back into the starting position $P_A$ by a renewed actuation of the actuation lever 32. In this regard the receptacle for items to be washed 11 is moved on account of its dead weight and in particular on account of the weight of the items to be washed also against the supporting force of the drive facility, preferably embodied as a spring element, into the starting position. In such cases the braking facility 38 brakes the movement of the receptacle for items to be washed 11 so that an uncontrolled movement or acceleration of the same is ruled out.

Figure 4:
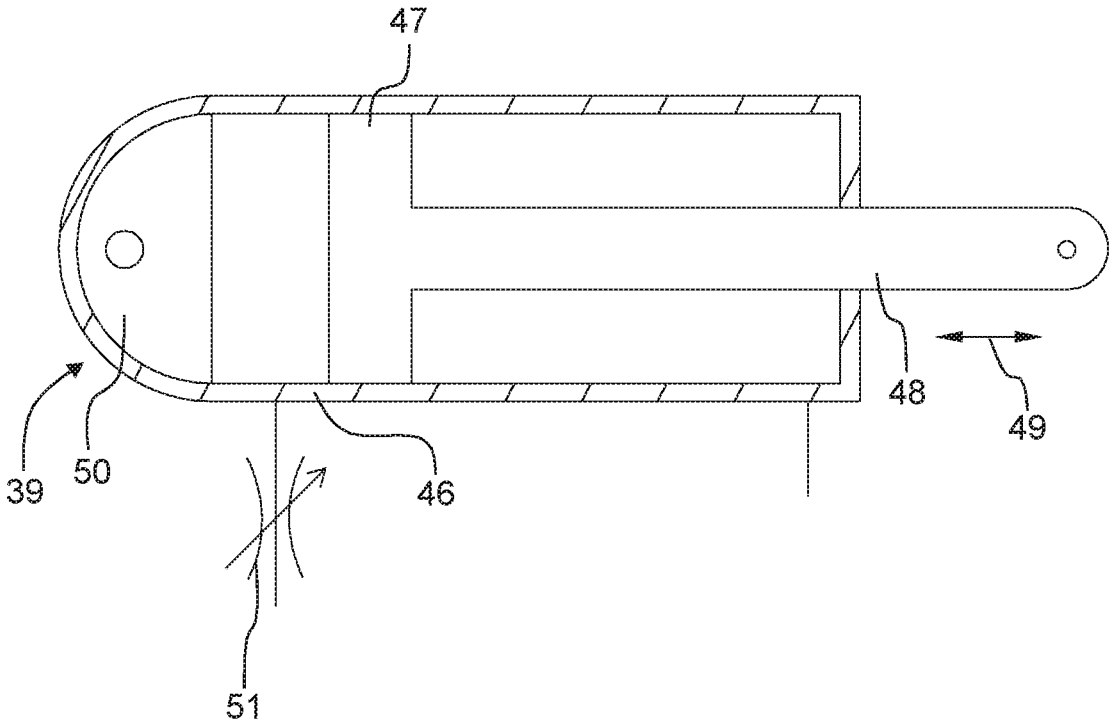
FIG. 4 shows a schematic side view of an embodiment of a damping element for the lifting device according to FIG. 2.

FIG. 4 shows a schematic sectional view of an embodiment of a linear damping element 39. The damping element 39 has a housing 46, in which a moveable piston 47 is provided, which is connected to a damper stay 48. The piston 47 can move to and fro in the housing 46, as shown in FIG. 4 with the aid of an arrow 49. The damping element 39 is a gas or oil damper, for instance. The housing 46 has a fastening section 50, which can be pivotably fastened to the receptacle carrier for items to be washed 19 for instance. The damper stay 48 is pivotably fastened to the second scissor arm 17, for instance. The damping element 39 is therefore arranged between the receptacle carrier for items to be washed 19 and the second scissor arm 17.

The damping element 39 can also have a throttle 51. With the aid of the throttle 51 the lowering speed of the receptacle for items to be washed 11 can be set. Furthermore, the damping element 39 can also be set with the aid of the throttle 51 such that during the lifting process of the receptacle for items to be washed 11 from the starting position $P_A$ into the end position, its movement is not braked or is braked less than during the lowering process. The throttle 51 can be coupled to the actuation lever 32 such that the damping element 39 is deactivated during the lifting process of the receptacle for items to be washed 11 and is activated in particular during the lowering process of the receptacle for items to be washed 11. Furthermore, the throttle 51 can also be controlled such that the damping effect of the damping element 39 is greater in particular during the lowering process of the receptacle for items to be washed 11 than during the lifting process of the same.

Figure 5:
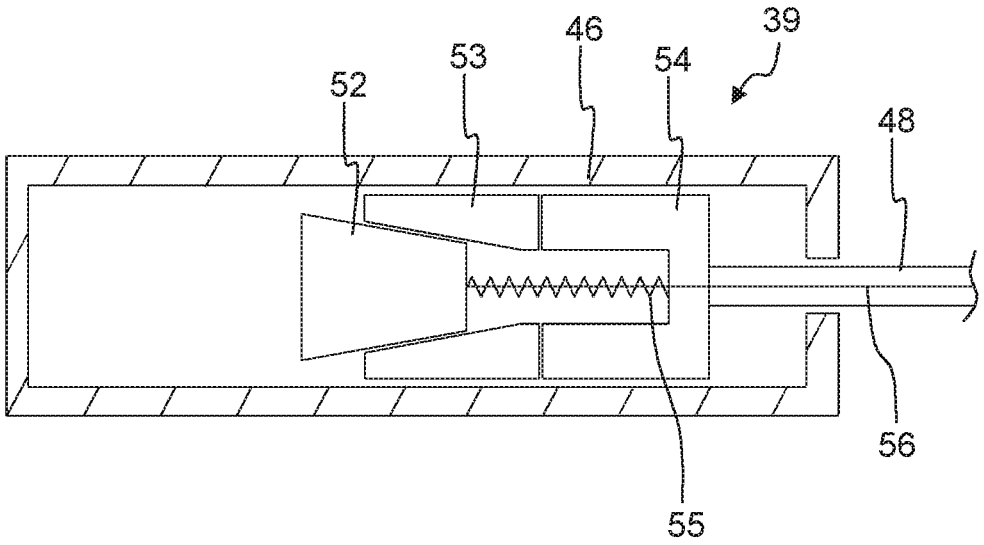
FIG. 5 shows a schematic side view of a further embodiment of a damping element for the lifting device according to FIG. 2.
Figure 6:
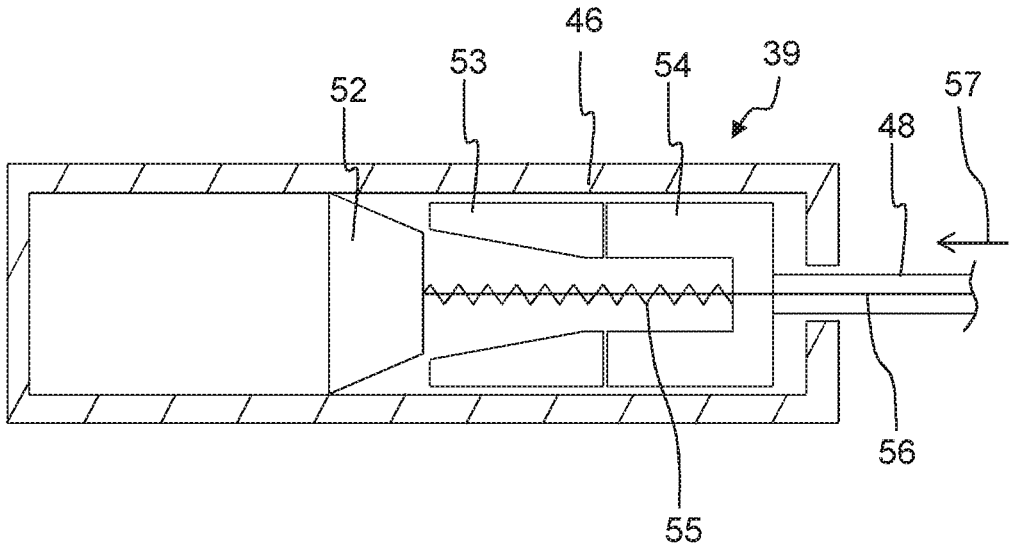
FIG. 6 shows a further schematic side view of the damping element according to FIG. 5.

FIG. 5 and FIG. 6 show a further embodiment of a linear damping element 39. A conical expansion body 52 is provided in a housing 46 of the damping element 39. The expansion element 52 can expand radially. The damping element 39 can be brought from an unactuated or deactivated state shown in FIG. 5 into an actuated or activated state shown in FIG. 6. The expansion body 52 is arranged in the unactuated state in a conical body 53. A damper stay 48 is connected to a base body 54, which is arranged between the conical body 53 and the damper stay 48. The conical body 53 is fixedly connected to the base body 54 or is embodied in one piece therewith.

A spring element 55, in particular a compression spring, is received in the conical body 53 and the base body 54. An actuation element 56, in particular a steel cable, connected to the expansion element 52 is passed through the damper stay 48. The actuation element 56 can be coupled to the actuation lever 32. If the actuation element 56, as shown in FIG. 6 with the aid of an arrow 57, is moved toward the left in the orientation in FIG. 6, the expansion element 52 is released and the spring element 55 presses the expansion element 52 out of the conical body 53, so that the expansion element 52 expands and comes into contact with the housing 46. The expansion element 52 expands in the manner of a fan when moving out from the conical body 53, for instance. A damping effect is achieved by contact between the expansion element 52 and the housing 46. The damping effect of the damping element 39 can be set depending on the materials used for the expansion element 52 and the housing 46 as well as the force with which the expansion element 52 presses internally against the housing 46. The damping element 39 can be coupled to the actuation lever 32 for instance such that the damping element 39 is deactivated during the lifting process of the receptacle for items to be washed 11 and in particular during the lowering process of the same. The housing 46 can be embodied to be water tight, so that the damping element 39 can be arranged in the dishwasher cavity 2.

Figure 7:
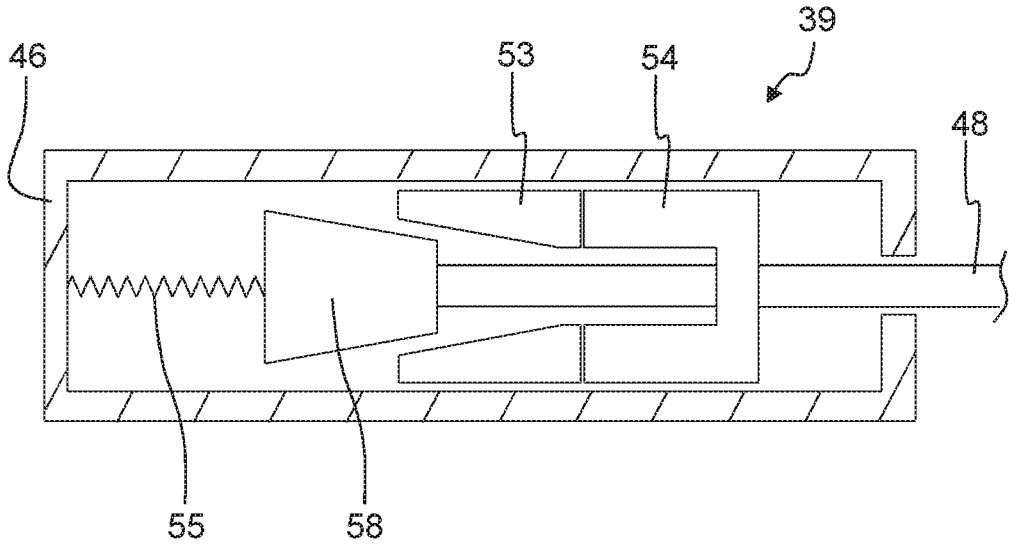
FIG. 7 shows a schematic side view of a further embodiment of a damping element for the lifting device according to FIG. 2.
Figure 8:
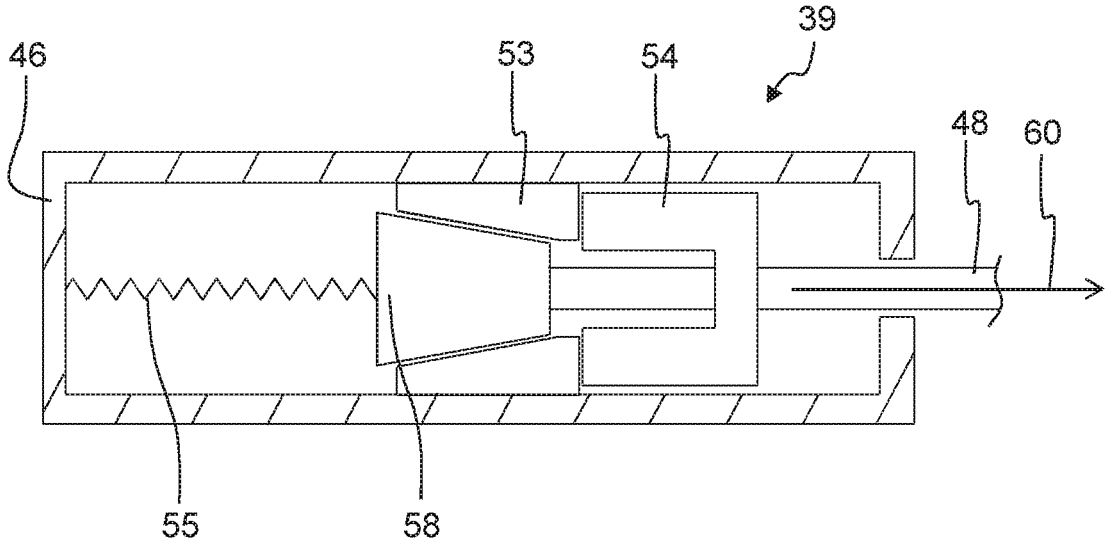
FIG. 8 shows a further schematic side view of the damping element according to FIG. 7.

FIG. 7 and FIG. 8 show a further embodiment of a linear damping element 39. The damping element 39 comprises a housing 46, in which a linearly moveable conical body 58 is arranged, which, with the aid of a spring element 55, in particular a compression spring, is prestressed in the direction of a friction body 59. The friction body 59 can be divided completely into various segments. When displacing a damper stay 48 toward the right in the orientation in FIG. 8, as shown with the aid of an arrow 60, the conical body 58 is moved into the friction element 59, as a result of which this is pressed against an inner wall of the housing 46. The required damping effect can be set by way of the contact surface, the spring force of the spring element 55 and the friction coefficients of the various materials of the friction body 59 and the housing 46. The damping effect is preferably activated or deactivated by the damper stay 48 so that the damping element 39 is activated when the damper stay 48 is pulled out of the housing 46, in other words during the lowering process of the receptacle for items to be washed 11, and is deactivated when sliding the same in, in other words when lifting the receptacle for items to be washed 11 into the housing 46. The housing 46 can be made to be water tight.

Figure 9:
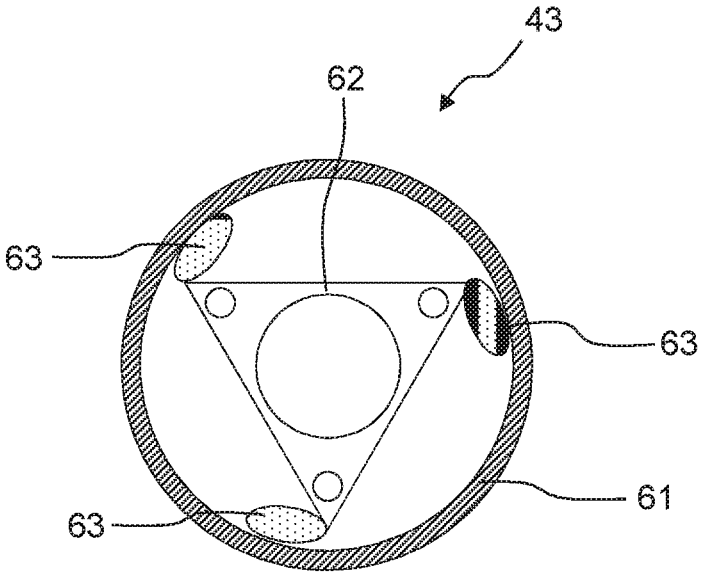
FIG. 9 shows a schematic side view of a further embodiment of a damping element for the lifting device according to FIG. 2.

FIG. 9 shows an embodiment of a damping element 43 which is embodied as a rotation damper. For instance, the damping element 43 can be embodied as a centrifugal force brake. The damping element 42 comprises a housing 61 in which a rotatable rotor 62 is arranged. Friction elements 63 are provided on the rotor 62, which are pressed internally onto the housing 61 as a function of the rotational speed of the rotor 62. This achieves a damping effect. In order to achieve the required rotational speed of the rotor 62, a transmission facility or a gearing can be provided on a corresponding pivot point 18, 21, 23, 26, 30, 33, 35, 37 of the lifting device 14, on which the damping element 43 is provided.

Figure 10:
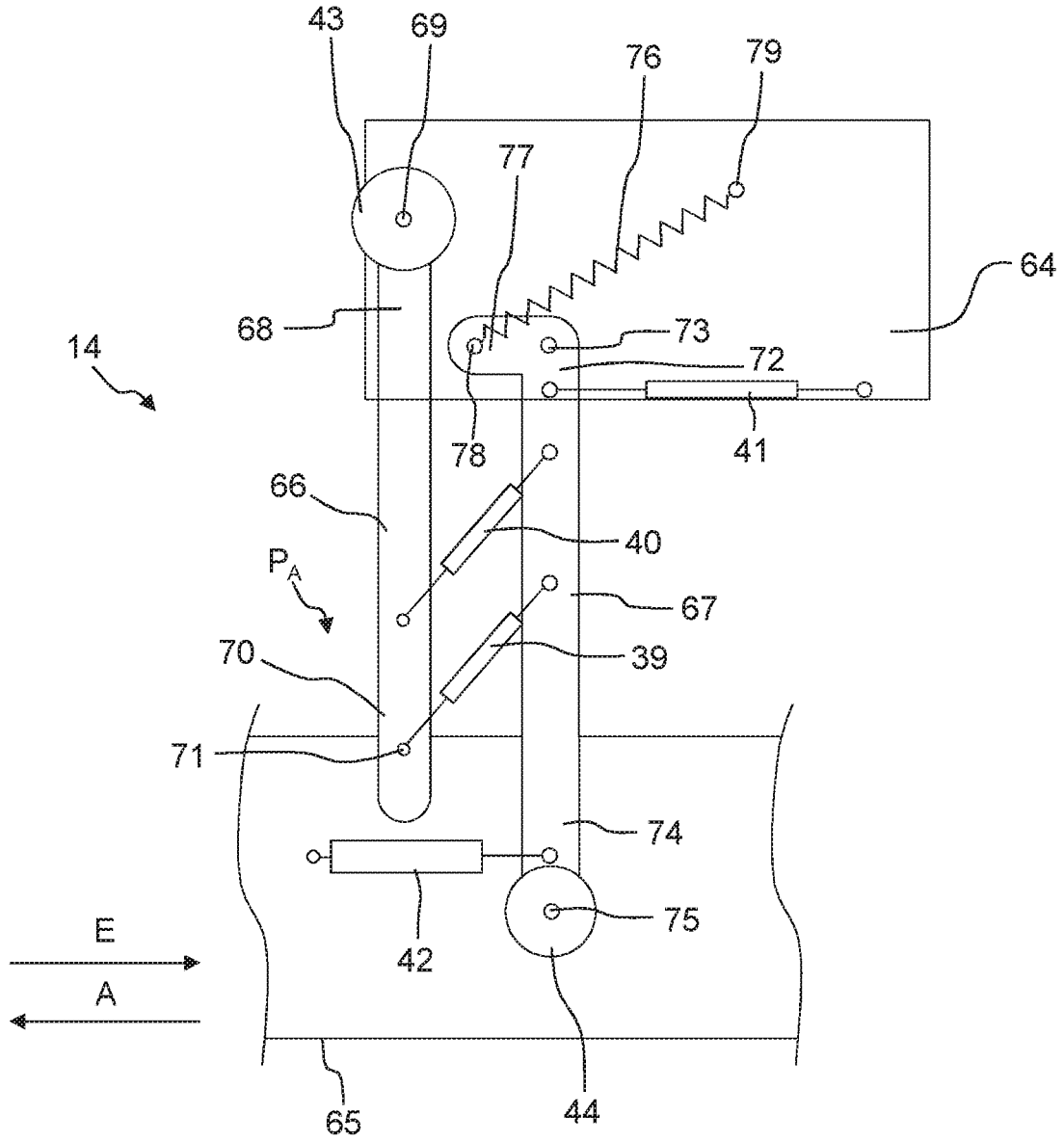
FIG. 10 shows a schematic side view of a further embodiment of a lifting device for the dishwasher according to FIG. 1.
Figure 11:
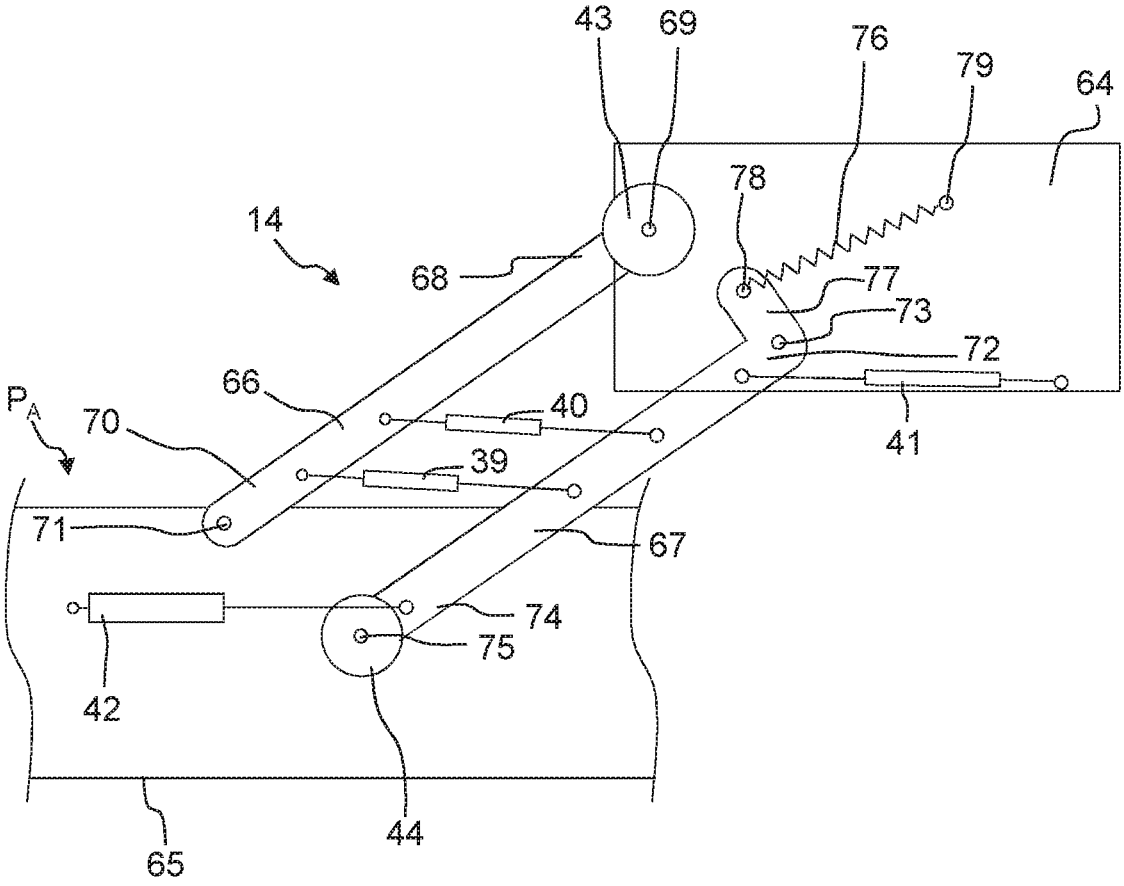
FIG. 11 shows a further schematic side view of the lifting device according to FIG. 10.

FIG. 10 and FIG. 11 show a further embodiment of a lifting device 14. The lifting device 14 comprises a fastening plate 64, which is arranged on one of the side walls 9, 10 of the dishwasher cavity 2. A lifting device 14 of this type is preferably provided on both sides of the receptacle for items to be washed 11. The lifting device 14 further comprises a guide facility 65, with the aid of which in the starting position $P_A$ the receptacle for items to be washed 11 can be moved out of the dishwasher cavity in the extraction direction A and can be moved into the dishwasher cavity 2 in the insertion direction E. The guide facility 65 may be what is known as a telescopic rail. The receptacle for items to be washed 11 can be suspended in the guide facility 11.

The lifting device 14 comprises a first pivot arm 66 and a second pivot arm 67. The first pivot arm 66 is pivotably fastened to the fastening plate 64 at a first end segment 68 with a pivot point 69. The first pivot arm 66 is pivotably fastened on the guide facility 65 at a second end segment 70. To this end, a pivot point 71 is provided on the second end segment 70. The second pivot arm 67 is pivotably fastened to the fastening plate 64 at a first end segment 72 with a pivot point 73. At a second end segment 74, at which a pivot point 75 is provided, the second pivot arm 67 is pivotably fastened on the guide facility 65.

The lifting device 14 further comprises a drive facility 76 in the form of a spring element. The spring element is in particular a tension spring. The drive facility 76 is connected to the fastening plate 64 and the second pivot arm 67. To this end, a lever arm 77 is provided at the first end segment 72 of the second pivot arm 67. A bearing point 78 for the drive facility 76 is provided on the lever arm 77. The drive facility 76 can be suspended in the bearing point 78. A corresponding bearing point 79 for the drive facility 76 is likewise provided on the fastening plate 64. The drive facility 76 is designed to support the lifting process of the receptacle for items to be washed 11 with a supporting force.

Damping elements 43, 44 in the form of rotation dampers can be provided on the pivot points 69 and 75. Furthermore, damping elements 43, 44 of this type can also be provided on the pivot points 71 and 73. Further linear damping elements 39, 40, which are embodied as oil or gas pressure dampers for instance, can also be provided between the pivot arms 66, 67. Furthermore, the end segment 72 of the second pivot arm 67 can also be connected to the fastening plate 64 with the aid of a damping element 41. Moreover, a damping element 42 which is arranged between the guide facility 65 and the second pivot arm 67 can also be provided on the second end segment 74 of the second pivot arm 67. The number of damping elements 39 to 44 is arbitrary. The damping elements 39 to 44 are designed to brake the movement of the receptacle for items to be washed 11, in particular during the lowering process. The lifting device 14 can also comprise just one damping element 39 to 44.

Although the present invention has been described on the basis of exemplary embodiments, it can be modified in a variety of ways.

The invention claimed is:

1. A lifting device for a receptacle for items to be washed of a dishwasher, said lifting device being constructed to lift the receptacle for items to be washed from a starting position into an end position or to lower the receptacle from the end position into the starting position, said lifting device comprising:

a braking device including a damping element configured to brake a movement of the receptacle, a scissors lift configured to lift and lower the receptacle, wherein the scissors lift comprises first and second scissor arms which intersect one another and are pivotably connected to one another at a pivot point to allow lifting and lowering of the receptacle as a function of a pivot angle between the first and second scissor arms, and an actuation lever pivotably disposed at a pivot point on the receptacle and having an end segment pivotably connected to one of the first and second scissor arms of the scissors lift via an intermediate lever, the actuation lever also being operably connected to the damping element for allowing actuation of the damping element.

2. The lifting device of claim 1, wherein the damping element is configured to have an adjustable damping effect.

3. The lifting device of claim 2, wherein the damping effect of the damping element is adjustable such as to brake the movement of the receptacle more significantly during lowering of the receptacle than during lifting of the receptacle.

4. The lifting device of claim 1, wherein the damping element is configured so as to be activated or deactivated.

5. The lifting device of claim 1, wherein the damping element is configured such that the movement of the receptacle is only braked during lowering of the receptacle and unbraked during lifting of the receptacle.

6. The lifting device of claim 1, further comprising a receptacle carrier for carrying the receptacle, said damping element being arranged in one of three ways, a first way in which the damping element is arranged between the first and second scissor arms, a second way in which the damping element is arranged between the first and second scissor arms and the receptacle carrier, a third way in which the damping element is arranged at the pivot point of the first and second scissor arms.

7. The lifting device of claim 1, wherein the scissors lift is configured such that in a retracted state thereof the lifting device is movable out of and into a dishwasher cavity of the dishwasher.

8. The lifting device of claim 1, further comprising a drive facility configured to apply a supporting force to support a manual lifting or lowering of the receptacle.

9. The lifting device of claim 8, wherein the drive facility is constructed in the form of a spring element.

10. A dishwasher, comprising:

a dishwasher cavity;

a receptacle for items to be washed, said receptacle being receivable in the dishwasher cavity; and a lifting device constructed to lift the receptacle from a starting position into an end position or to lower the receptacle from the end position into the starting position, said lifting device comprising:

a braking device including a damping element configured to brake a movement of the receptacle, a scissors lift configured to lift and lower the receptacle, wherein the scissors lift comprises first and second scissor arms which intersect one another and are pivotably connected to one another at a pivot point to allow lifting and lowering of the receptacle as a function of a pivot angle between the first and second scissor arms, and an actuation lever pivotably disposed at a pivot point on the receptacle and having an end segment pivotably connected to one of the first and second scissor arms of the scissors lift via an intermediate lever, the actuation lever also being operably connected to the damping element for allowing actuation of the damping element.

11. The dishwasher of claim 10, constructed in the form of a household dishwasher.

12. The dishwasher of claim 10, wherein the damping element is configured to have an adjustable damping effect.

13. The dishwasher of claim 12, wherein the damping effect of the damping element is adjustable such as to brake the movement of the receptacle more significantly during lowering of the receptacle than during lifting of the receptacle.

14. The dishwasher of claim 10, wherein the damping element is configured so as to be activated or deactivated.

15. The dishwasher of claim 10, wherein the damping element is configured such that the movement of the receptacle is only braked during lowering of the receptacle and unbraked during lifting of the receptacle.

16. The dishwasher of claim 10, wherein the lifting device includes a receptacle carrier for carrying the receptacle, said damping element being arranged in one of three ways, a first way in which the damping element is arranged between the first and second scissor arms, a second way in which the damping element is arranged between the first and second scissor arms and the receptacle carrier, a third way in which the damping element is arranged at the pivot point of the first and second scissor arms.

17. The dishwasher of claim 10, wherein the scissors lift is configured such that in a retracted state thereof the lifting device is movable out of and into a dishwasher cavity of the dishwasher.

18. The dishwasher of claim 10, further comprising a drive facility configured to apply a supporting force to support a manual lifting or lowering of the receptacle.

19. The dishwasher of claim 18, wherein the drive facility is constructed in the form of a spring element.

* * * * *